United States Patent [19]

Robbins, Jr.

[11] 4,188,918

[45] Feb. 19, 1980

[54] INTERNAL COMBUSTION ENGINE HAVING INDUCTED CHARGE CONTROL MEANS DRIVEN BY ENGINE THROUGH VARIABLE SPEED HYDRAULIC TRANSMISSION

[76] Inventor: Urban G. Robbins, Jr., 402 Chambers St., Sp. 62, El Cajon, Calif. 92020

[21] Appl. No.: 919,144

[22] Filed: Jun. 26, 1978

[51] Int. Cl.[2] ..... F02B 33/44

[52] U.S. Cl. ..... 123/25 R; 123/75 E; 123/119 CE

[58] Field of Search ..... 123/119 C, 119 CA, 119 CE, 123/75 E, 25 R, 25 A, 25 L

[56] References Cited

U.S. PATENT DOCUMENTS

| | | | |
|---|---|---|---|
| 2,292,233 | 8/1942 | Lysholm | 123/75 E |
| 2,651,297 | 9/1953 | Eastman | 123/119 CE |
| 2,725,046 | 11/1955 | Wilder | 123/119 CE |
| 2,936,575 | 5/1960 | Lieberherr | 123/75 E |
| 2,977,943 | 4/1961 | Lieberherr | 123/75 E |
| 3,296,791 | 1/1967 | Richard et al. | 123/119 CA |
| 3,921,403 | 11/1975 | McInerney et al. | 123/119 C |

*Primary Examiner*—Ira S. Lazarus

*Attorney, Agent, or Firm*—Eric P. Schellin

[57] ABSTRACT

An internal combustion engine is provided with air-charge or fuel-air-charge induction means which acts as a supercharger during one mode of operation and as a subcharger during another mode. The induction means is mechanically driven from the engine via a variable speed hydraulic transmission arrangement. Means are provided to appropriately change the hydraulic circuit at the moment when power flow through the hydraulic transmission changes direction. During the subcharging mode the air-charge or fuel-air-charge induction means acts as a throttle, but the energy lost in the resulting pressure drop is returned to the engine by way of the variable speed hydraulic transmission arrangement.

8 Claims, 3 Drawing Figures

VIEW 1
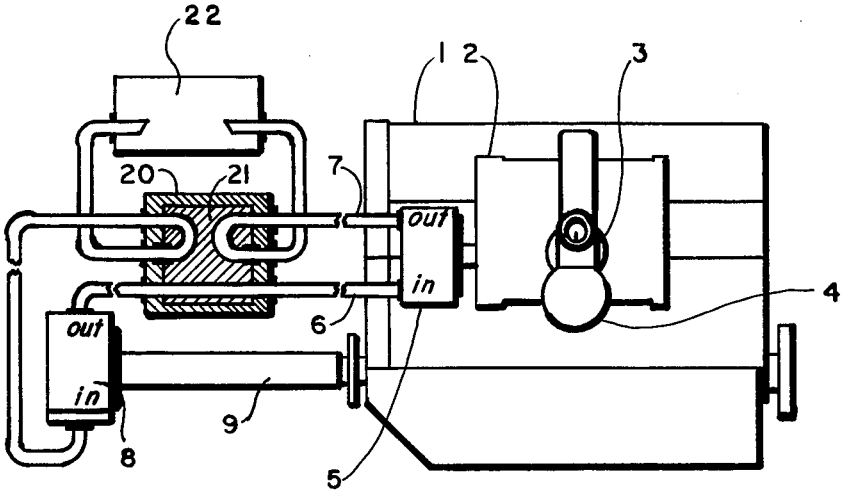
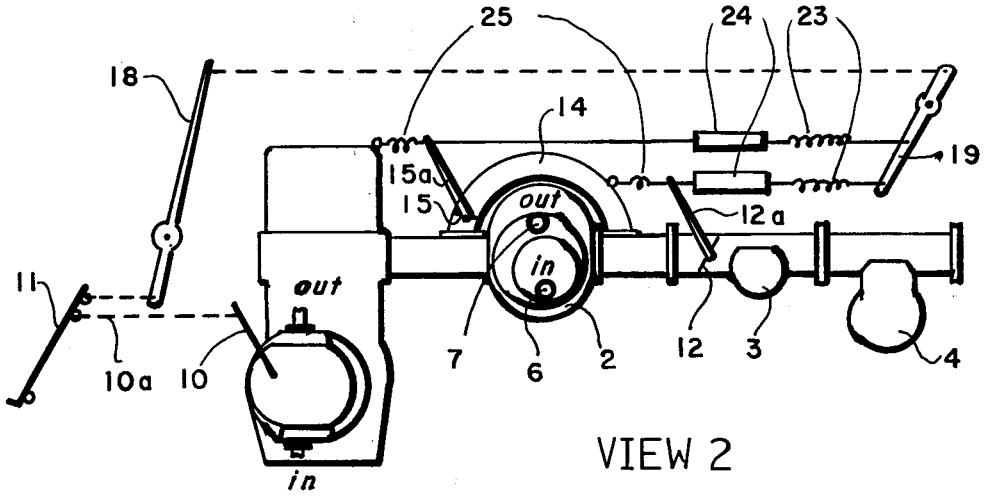
VIEW 2
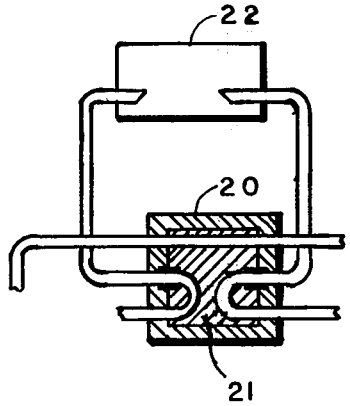
VIEW 3

INTERNAL COMBUSTION ENGINE HAVING INDUCTED CHARGE CONTROL MEANS DRIVEN BY ENGINE THROUGH VARIABLE SPEED HYDRAULIC TRANSMISSION

BACKGROUND OF THE INVENTION

The engine most often used in automobiles today is the conventional four-stroke Otto cycle engine. The engine output is usually varied by means of a butterfly throttle which controls the amount of air or fuel-air mixture inducted into the engine. A butterfly throttle acts as a restrictor and produces a pressure drop which constitutes an energy loss. At steady cruising speeds, when the engine is turning over rapidly, and the accelerator pedal is only partially depressed, this energy loss is significant.

In order to recover the energy which would be lost at a butterfly valve, in the instant invention the amount of air or fuel-air charge inducted into the engine is controlled by a blower which acts as a metering pump during a subcharging mode and acts as a supercharger during a supercharging mode.

The blower is driven from the engine by means of a variable speed hydraulic transmission, the speed ratio of which is controlled by the accellerator pedal. Thus, when the accelerator pedal is depressed so as to call for more power, the speed ratio of the variable speed hydraulic transmission changes to accelerate the blower, thereby inducting more air or fuel-air charge into the engine.

Since it takes a few moments for the blower to increase its speed, in order to provide quick acceleration, the blower is temporarily shunted by a performance by-pass duct, normally closed by a performance valve. The performance valve opens momentarily when the accelerator pedal is tromped on, thereby permitting the engine to increase its speed rapidly, without throttling by the blower. As soon as the blower has come up to the speed dictated by the position of the accelerator pedal, the performance valve closes.

The direction of power flow, through the variable speed hydraulic transmission, reverses when there is a change back and forth between the supercharging and the subcharging mode. However, the engine and blower always turn in the same direction, so that the motion of oil through certain portions of the hydraulic circuit necessarily also is in a constant direction. The conditions of the two preceeding sentences can cause operating troubles, which are avoided by introducing valving means into the hydraulic circuit to automatically switch the hydraulic circuit so that the portion thereof which acts as a pump is always directly connected to the portion thereof which acts as a motor. This avoids significant negative oil pressures in the pump circuit.

Combined with the novel engine is a variable compression ratio means and water feeding means, to provide cleaner burning, better running, and lower emissions over the range of speeds and loadings encountered.

THE DRAWINGS

FIG. 1 is a side view, partly in cross section, of the engine disclosed herein.

FIG. 2 is a diagramatic view of the said engine showing some details of the accelerator pedal linkage, carburetion, water feeding, blower and blower drive means, with the parts spread out so as to be more readily readable.

FIG. 3 is a cross sectional view of the transfer function valve, also seen in FIG. 1, but set in its alternate position.

DETAILED DESCRIPTION

The engine 1 is provided with a positive displacement blower, such as a Rootes blower, 2, to blow into the cylinders the fuel-air mixture obtained from carburetor 3 and supplied with water by water carburetor 4. It will be understood that the fuel can also be directly injected through the intake ports or through the cylinder head, and if this is done, the carburetor does not add any fuel to the inducted air.

The blower 2 is coupled to a positive displacement hydraulic motor pump 5. During periods of considerable acceleration the hydraulic motor 5 drives the blower 2. During periods of constant high speed operation with a light constant touch on the accelerator or pedal, however, the blower is driven by the air or fuel-air charge, sucked in by the engine, to drive the hydraulic motor-pump 5. Whether the hydraulic motor-pump 5 drives the blower 2, or vice-versa, depends upon which one tends to go faster and which one tends to go slower. Since the blower 2 and hydraulic motor-pump 5 are coupled together, they must run at the same speed. However, the blower 2 tends to follow the speed of engine 1, while the motor-pump 5 tends to follow the speed of the oil in the hydraulic circuit, including inlet tube 6 and outlet tube 7.

The oil in the hydraulic circuit is driven by pump-motor 8, which is powered from the crankshaft of engine 1 by coupling 9. Pump-motor 8 normally acts as a pump, to drive motor-pump 5 as a motor. However, when motor-pump 5 acts as a pump, it drives pump-motor 8 as a motor, to return mechanical power to the crankshaft.

The motor-pump 5 and the motor-pump 8 are both positive displacement. The reason one is designated a motor-pump and the other is designated a pump-motor is to distinguish the functions of the two. When one acts as a pump, it drives the other, which then acts as a motor. When said other acts as a pump, said one is driven and acts as a motor.

The pump-motor 8 must be a variable positive displacement device, and has a variable pump control lever 10 (FIG. 2) which controls the output volume of pump-motor 8 from maximum down to near zero. The motor-pump 5, on the other hand, can be but need not be adjustable, with its control inverse that of pump-motor 8. It is advisable to make it adjustable to give a broader speed pressure ratio range with lesser peak pressure.

The combination of a variable pump-motor 8 and a non-adjustable motor-pump 5 constitutes a variable speed hydraulic transmission, having a speed ratio which depends upon the setting of variable pump control lever 10.

The setting of variable pump control lever 10 is controlled by accelerator pedal 11 through linkage 10*a*. When the accelerator pedal 11 is depressed, it moves variable pump lever 10 from the position shown to a position further to the right, thereby increasing the volume of hydraulic oil pumped by pump-motor 8 from near zero to a substantial quantity. This speeds up the motor-pump 5, causing the blower 2 to blow more air or fuel-air mixture into the engine 1.

It will be understood that the motor-pump 5 may be adjustable as well as, or instead of, the pump-motor 8.

The air or fuel-air intake system of the motor 1 includes, as best shown in FIG. 2, the water carburetor 4, the fuel carburetor 3 and the blower 2.

The fuel carburetor 3 is provided with a butterfly valve 12 which is normally kept wide open, and is closed part way only during brief periods of sudden deceleration and at curb idle, as described below. Normal variations in speed and acceleration are accomplished, with the normally fixed setting of butterfly valve 12, by accelerator pedal controlled variations in the speed of blower 2, as controlled by variable pump control lever 10.

At curb idle, the butterfly valve 12 is kept partly closed so as to keep the idle jet in the carburetor active, so that the engine will idle smoothly.

The blower 2 has a performance by-pass duct 14 which is normally kept closed by performance valve 15, and which is opened wide only during brief periods of full acceleration as described below, at which time the engine is in the subcharge mode and momentarily runs faster than the speed which would be determined by the blower.

During driving with normal speeds and normal acceleration, the power of the engine 1 is controlled solely by variable pump control lever 10, as moved by accelerator pedal 11 and acceleration linkage 10*a*.

However, during periods of intense acceleration, as when the accelerator is floored, it would take the hydraulic transmission too long to accelerate the blower 2 to a sufficient speed to, in turn, speed up the engine 1 the desired amount. Accordingly, means are provided to quickly accelerate the engine.

These means comprise the performance by-pass duct 14, the performance valve 15 and the carburetor butterfly 12. When extreme acceleration is called for at a time when the engine is in the subcharge mode, the performance valve 15 and the carburetor butterfly 12 are briefly opened wide, and the engine gulps in the fuel-air mixture in the same way that a conventional gasoline engine does. The levers 15*a* and 12*a* which open performance valve 15 and carburetor butterfly 12 are driven by time delay linkage, which promptly relax after opening the performance valve 15 and carburetor 12, permitting them to again resume their normal setting. By the time this happens, the blower 2 has speeded up to the point where it again is able to solely, by variations of its speed, properly control the power output of engine 1.

The time delay linkages include magnitude amplifying lever 18, lever 19, tensile springs 23, fluid delay means 24 and tensile springs 25. The fluid delay means 24 include a tensile spring, not shown, which is weaker than tensile springs 23 and 25 and also includes a pneumatic or hydraulic piston with a leak, not shown, but similar to that of a conventional shock absorber. The result is that when lever 19 pulls on springs 23, the delay means 24 immediately extends springs 25 to move levers 15*a* and 12*a* to the right. But then the weak springs in delay means 24 gives way under the pull of stronger springs 23 and 25, since the weak springs are no longer backed by the leaky pneumatic or hydraulic pistons. Accordingly, the performance valve 15 and the carburetor butterfly valve 12 return to their normal positions.

It will be seen, from the above, that since the speed of the blower 2 controls the power of engine, at times the blower 2 will tend to drag on motor-pump 5 (during the supercharging mode) and at times the motor-pump 5 will tend to drag on the blower 2 (during the subcharging mode). Thus, the direction of power flow between pump-motor 8 and motor-pump 5 reverses from time to time.

In view of this reversal, if the hydraulic circuit were the same all the time, negative pressures might result. Such negative pressures produce bubbles which can be troublesome in a hydraulic system. Accordingly, the hydraulic system is provided with an automatically activated transfer function valve 20 which switches the piping, at the moment of power direction reversal, so that there always is a direct connection between that port of the pump-motor 8 and that port of motor-pump 5 which are under pressure. At the same times, the remaining ports of pump-motor 8 and motor-pump 5 which are the lower pressure sides, are connected directly to the pump-oil reservoir 22. Thus, no significant negative pressures result in the hydraulic circuit.

The transfer function valve 20 is shown in FIG. 1 as having a rotor 21 set in a valve body with three inlets and three outlets. The rotor 21 is positioned in FIG. 1 so as to be suited to the supercharger mode, wherein the pump-motor 8 drives motor-pump 5. It will be seen that the conduit 6 provides a direct connection, at high pressure between pump-motor 8 and motor-pump 6.

If the power flow in the hydraulic circuit reverses, as when the supercharging mode gives way to the subcharging mode, the rotor 21 automatically flips to the position shown in FIG. 3. Upon comparison of FIG. 3 with FIG. 1 it will be seen that, in the subcharging mode, when motor-pump 5 drives pump-motor 8, the conduit 7, which is now the high pressure conduit, is a direct connection between motor-pump 5 and pump-motor 8, while the other conduits, at low pressure, lead to pump-oil reservoir 22.

The rotor 21 is so constructed that, when it flips, it does not cut off any of the conduits, so that no dangerous pressures are created. This is done by building the passageways so that they briefly overlap, during flipping, in a manner similar to an electrical make-before-break transfer switch.

The rotor 21 is flipped automatically by snap action means, activated by two pistons, which respond to the presence of low pressure respectively in conduits 6 and 7.

The description above is exemplary. It is contemplated that in commercial production the motor-pump 5, transfer function valve 20 and pump-motor 8 could be incorporated into a single unit. Furthermore, it is contemplated that this single unit could be made part of the automatic drive transmission of the motor vehicle.

What is claimed is:

1. In a spark ignition piston-type internal combustion engine:

means to variably control the quantity of air induced into the engine, said means comprising a positive displacement air blower;

means to mechanically drive said air blower by a positive displacement hydraulic motor-pump;

means to hydraulically drive said positive displacement motor-pump by a variable positive displacement hydraulic pump-motor;

means to mechanically drive said variable displacement pump-motor by power obtained from the engine;

means to control the variable displacement of said hydraulic pump-motor in accordance with the position of an acceleration control, whereby the quantity of air inducted into the engine is controlled by the position of said acceleration control.

2. An engine according to claim 1 having means for using water as part of the charge inducted into the engine.

3. An engine according to claim 2 in which said last named means is a water carburetor.

4. An engine according to claim 2 in which said last named means is a means for directly injecting water into the input duct.

5. An engine according to claim 2 having means to change the compression ratio of the engine.

6. An engine according to claim 1 having means to change the compression ratio of the engine.

7. An engine according to claim 1 having:

a by-pass duct in shunt to said positive displacement air blower;

a valve normally closing said by-pass duct; and means to briefly open said valve for the duration of a period in which the acceleration control is activated to produce great acceleration.

8. An engine according to claim 1 having a transfer function valve to transfer the flow to and from the said motor-pump and said pump-motor so as to avoid high suction pressures;

said transfer function valve being activated automatically in response to the presence of undesired suction pressure in any of the hydraulic circuits.

* * * * *